US006152633A

United States Patent [19]

Kim et al.

[11] Patent Number: 6,152,633

[45] Date of Patent: Nov. 28, 2000

[54] COMPACT ARTICLE FOR ORAL CARE

[76] Inventors: Dae S. Kim; Gil Hee K. Kim, both of 28031 Ridgebrook Ct., Rancho Palos Verdes, Calif. 90275

[21] Appl. No.: 09/481,873

[22] Filed: Jan. 12, 2000

Related U.S. Application Data

[63] Continuation-in-part of application No. 09/451,025, Nov. 29, 1999.

[51] Int. Cl.[7] ..... A46B 11/02

[52] U.S. Cl. ..... 401/124; 401/126; 401/129; 132/308; 132/311

[58] Field of Search ..... 401/123–125, 401/126, 127, 129; 132/308, 311

[56] References Cited

U.S. PATENT DOCUMENTS

| | | | |
|---|---|---|---|
| 793,259 | 6/1905 | Wilson | 401/124 |
| 1,274,116 | 7/1918 | Weber | 132/308 |
| 1,558,195 | 10/1925 | McEnaney | 132/308 |
| 2,468,733 | 5/1949 | Boulicault | 132/308 |
| 2,527,741 | 10/1950 | Lamonde | 132/308 |
| 2,868,215 | 1/1959 | Mechem | 401/123 |

*Primary Examiner*—Charles R. Eloshway
*Attorney, Agent, or Firm*—John K. Park; Park & Sutton LLP

[57] ABSTRACT

A compact article for oral care comprises a housing and a tooth brush section. The housing has a first opening, a second opening, a third opening, a front end, a rear end, and a cavity communicating with the first, second and third openings. The first opening is formed through the front end and a conventional tooth paste tube having a neck is inserted through the third opening into the cavity. The tooth paste tube can be squeezed through the second opening to allow a desired amount of the tooth paste to flow out of the neck. The tooth brush section has a base, a first extension, a second extension, a connecting rod and a brush. The first extension is protruded in a decremental step from the base to a forward direction, and the second extension is protruded in a decremental step from the base to a rearward direction opposed to the first extension.

3 Claims, 3 Drawing Sheets

COMPACT ARTICLE FOR ORAL CARE

This is a continuation in part of application Ser. No. 09/451,025, filed on Nov. 29, 1999.

BACKGROUND OF THE INVENTION

The present invention relates to a combination article of a tooth brush and a tooth paste. More specifically, the present invention relates to an improved oral care article combining a tooth brush and a tooth paste, which enhances portability and usability.

Though various types of portable tooth brush sets are on the market, users demand further convenience for such oral care articles. To meet the need, a combination article of a tooth brush and a tooth paste has to be easy to use and convenient to handle. Also, it would be better if a conventional tooth paste tube can be utilized for such a combination article.

There is, therefore, a strong need for an oral care article combining a tooth brush and a tooth paste which can be used easily and conveniently for oral cleansing outdoors as well as indoors.

SUMMARY OF THE INVENTION

The present invention is contrived to overcome the conventional disadvantages. Accordingly, it is an object of the present invention to provide an article for oral care which realizes an ideal combination between a tooth brush and a tooth paste.

Another object of the present invention is to provide an article for oral care which substantially improves usability and portability.

To achieve the above-described objects and others, a compact article for oral care according to the present invention comprises a housing and a tooth brush section. The housing has a first opening, a second opening, a third opening, a front end, a rear end, and a cavity communicating with the first, second and third openings. The first opening is formed through the front end. A conventional tooth paste tube with a neck can be inserted through the third opening into the cavity. The third opening is sized by an opening rim at the rear end of the housing The neck of the tooth paste tube is removably fixed through the first opening and fastened by the neck cap while securely holding the tooth paste tube within the housing, and the tooth paste tube can be squeezed through the second opening to allow a desired amount of the tooth paste to flow out of the neck.

The tooth brush section has a base, a first extension, a second extension, a connecting rod and a brush. The first extension having a first perimeter is protruded in a decremental step from the base to a forward direction so that the connecting rod is fixedly attached to the first extension while fixedly attaching the brush to the connecting rod.

The second extension having a second perimeter is protruded in a decremental step from the base to a rearward direction opposed to the first extension. The first perimeter equals the second perimeter so that a selected one of the first and second extensions detachably carries thereon the opening rim of the housing through the third opening.

In a preferred version, the housing further comprises a clip having a base and an arm. The clip base is fixedly attached to a predetermined portion of an outer periphery of the housing, and the clip arm is elastically elongated toward the opening rim.

Alternately, the base comprises a clip having a base and an arm so that the clip base can be fixedly attached to a predetermined portion of an outer periphery of the base. Also, the clip arm is elastically elongated toward the connecting rod.

The second opening has a length and a width. The width is about one third the outer circumference of the housing, and the length is about one half the distance between the front end and the rear end of the housing.

According to a preferred version, the housing further comprises a hiatus. The front end of the housing has a pair of protrusions elastically approaching toward each other, forming the hiatus between the pair of protrusions, while channeling the first opening and the second opening.

In an improvement, the front end of the housing has a conventional tooth paste neck extending therefrom and a neck cap can be carried on the neck so that a neck hole in and through the neck can be the first opening. The flexible window sealingly covers the second opening, and a membrane is provided below the flexible window and between the first end and the second end so that a tooth paste can be contained between the membrane and the front end, whereby the flexible window can be pressed to squeeze out a desired amount of the tooth paste through the neck.

The advantages of the article for oral care are numerous. First, the article enables a conventional tooth paste tube to partially serve as a handle of the tooth brush, thereby realizing compactablility. Second, the threaded neck of the conventional tooth paste tube may be utilized for detachable but safe connection between the tooth brush section and the housing, thereby improving usability. Third, the simplified overall construction of the article for oral car according to the present invention may be further added by a clip, thereby enhancing portability.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
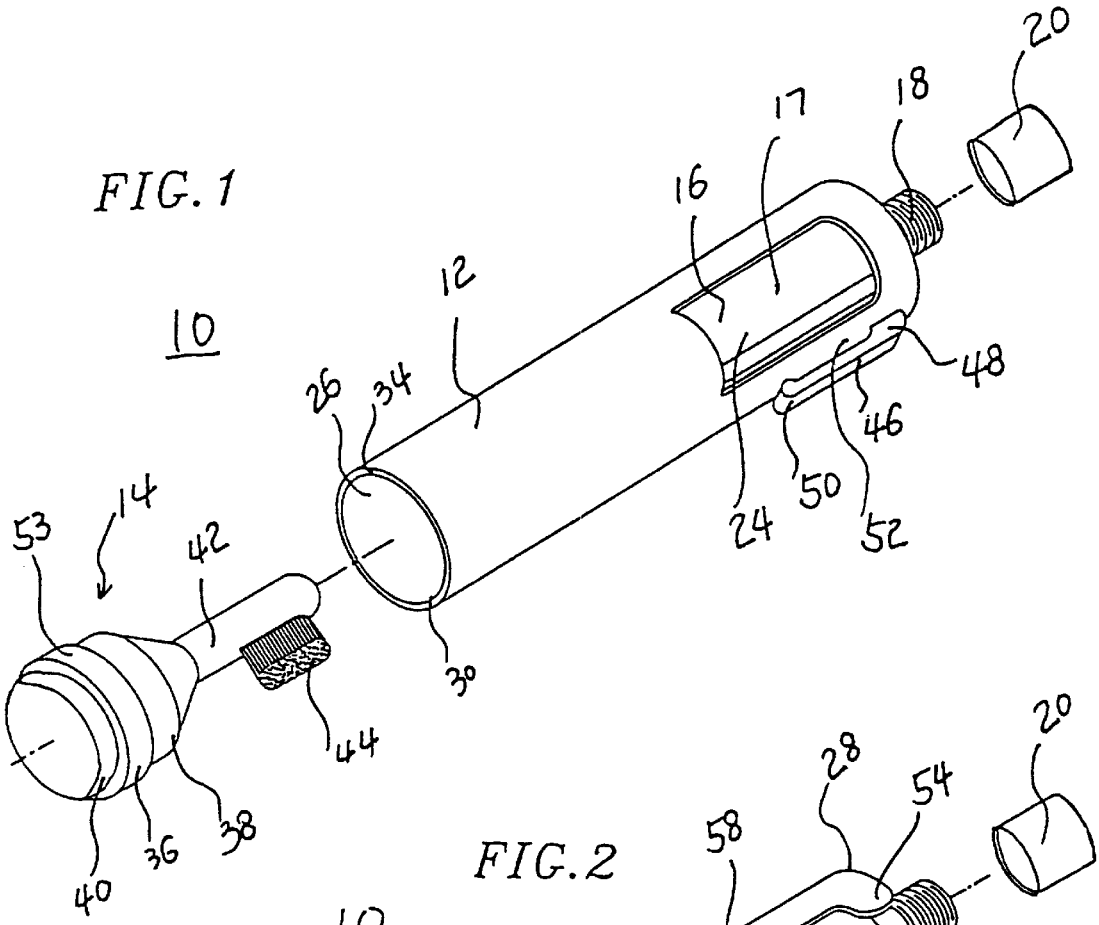
FIG. 1 is a perspective assembly view illustrating a compact article for oral care according to an embodiment of the present invention.

As shown in FIG. 1, a compact article 10 for oral care according to the present invention comprises a housing 12 and a tooth brush section 14. The housing 12 is sized and shaped in an elongate form to house therein a body 16 of a conventional tooth paste tube 17 having a neck 18 and a neck cap 20.

Figure 3:
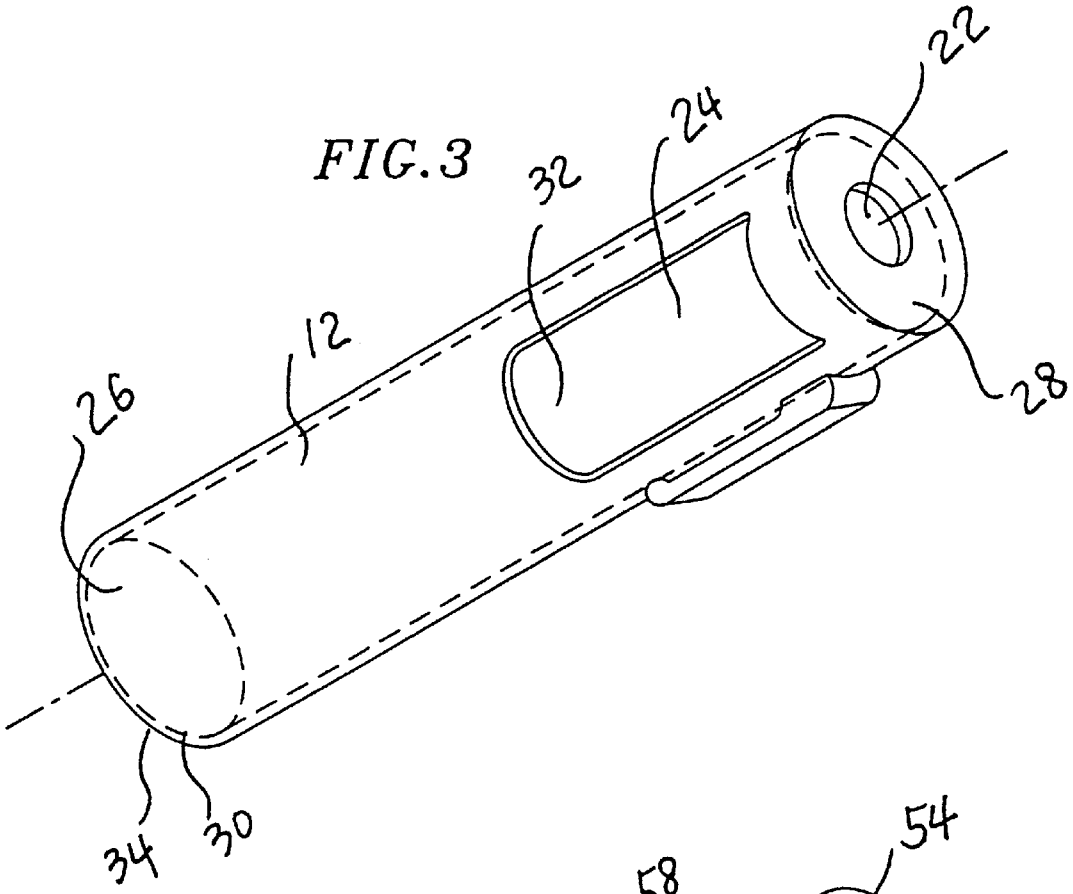
FIG. 3 is a perspective view illustrating a housing in FIG. 1.

Referring to FIGS. 1 and 3, the housing 12 according to a preferred embodiment of the present invention comprises a first opening 22, a second opening 24, a third opening 26, a front end 28, a rear end 30, and a cavity 32. The cavity 32 communicates with the first, second and third openings 22, 24, 26.

The first opening 22 is formed through the front end 28 so that the conventional tooth paste tube 17 can be inserted through the third opening 26 into the cavity 32. Specifically, the tooth paste tube 17 is placed at the third opening 26 and released through the cavity 32 toward the front end 28 until the neck 18 of the tooth paste tube 17 except for the body 16 is fully exposed out of the first opening 22. Then, the exposed neck 18 carries thereon the neck cap 20.

The third opening 26 is sized by an opening rim 34 at the rear end 30 of the housing 12. The neck 18 of the tooth paste tube 17 that has been inserted through the sized third opening 26 is removably fixed through the first opening 22 and fastened by the neck cap 20 while securely holding the tooth paste tube 17 within the housing 12.

To take tooth paste out of the hosed tube 17 in this construction, the tooth paste tube 17 can be squeezed through the second opening 24 to allow a desired amount of the tooth paste to flow out of the neck 18.

Meanwhile, the tooth brush section 14 comprises a base 36, a first extension 38, a second extension 40, a connecting rod 42 and a brush 44. The first extension 38 having a first perimeter is protruded in a decremental step from the base 36 to a forward direction. The connecting rod 42 is fixedly attached to the first extension 38 while fixedly attaching the brush 44 to the connecting rod 42. The second extension 40 having a second perimeter is protruded in a decremental step from the base 36 to a rearward direction opposed to the first extension 38. Here, the first perimeter of the first extension 38 equals the second perimeter of the second extension.

For connection between the housing 12 and the tooth brush section 14, a selected one of the first and second extensions 38, 40 detachably carries thereon the opening rim of the housing through the third opening. That is, the second extension 40 is fitted into the third opening 26 for use of the tooth brush section 14, whereas the first extension 38 is fitted into the third opening 26 for storage of the tooth brush section 14.

For a better performance, the housing 12 further comprises a clip 46 having a clip base 48 and a clip arm 50. The clip base 48 is fixedly attached to a predetermined portion 52 of an outer periphery of the housing 12, and the clip arm 50 is elastically elongated toward the opening rim 34.

Alternately, the base 36 of the tooth brush section 14 may comprise a clip 46 (not shown but same as the clip 46 of the housing 12) having a clip base 48 and a clip arm 50. The clip base 48 may be fixedly attached to a predetermined portion 53 of an outer periphery of the base 36. Also, the clip arm may be elastically elongated toward the connecting rod 42.

The second opening 24 has a length and a width. The width is about one third the outer circumference of the housing 12, and the length is about one half the distance between the front end 28 and the rear end 30 of the housing 12.

Figure 2:
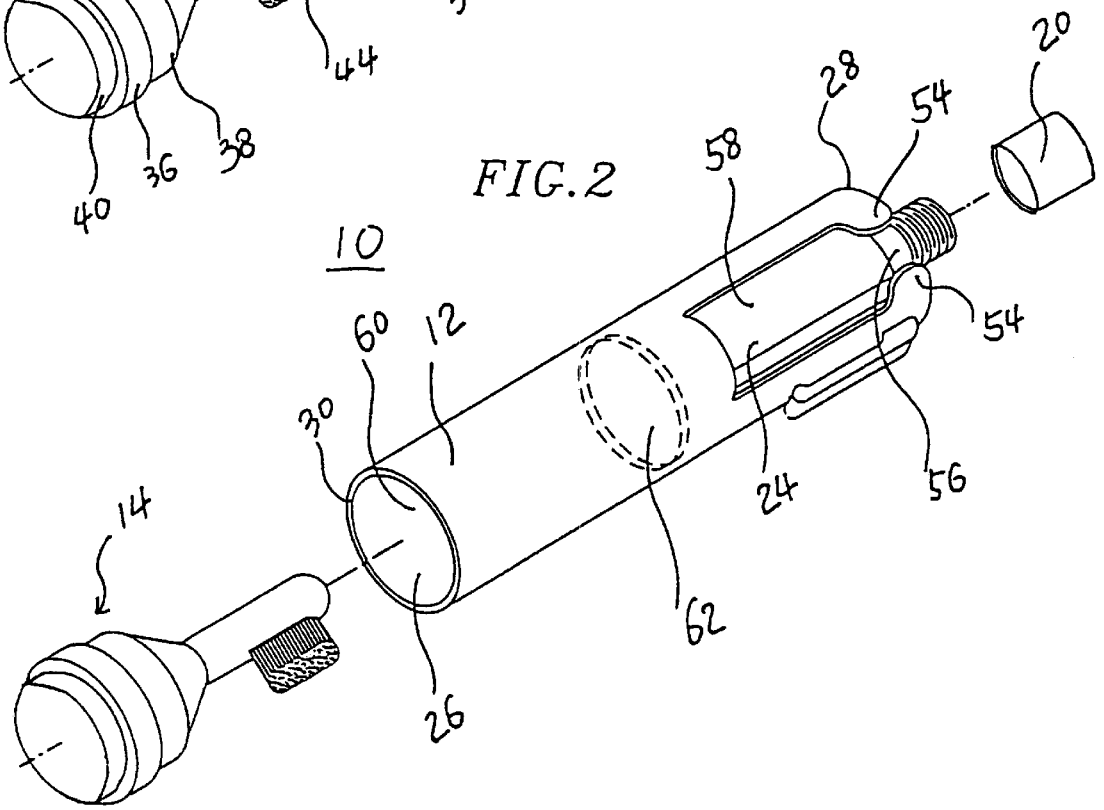
FIG. 2 is a perspective view illustrating a compact article for oral care according to another embodiment of the present invention.
Figure 4:
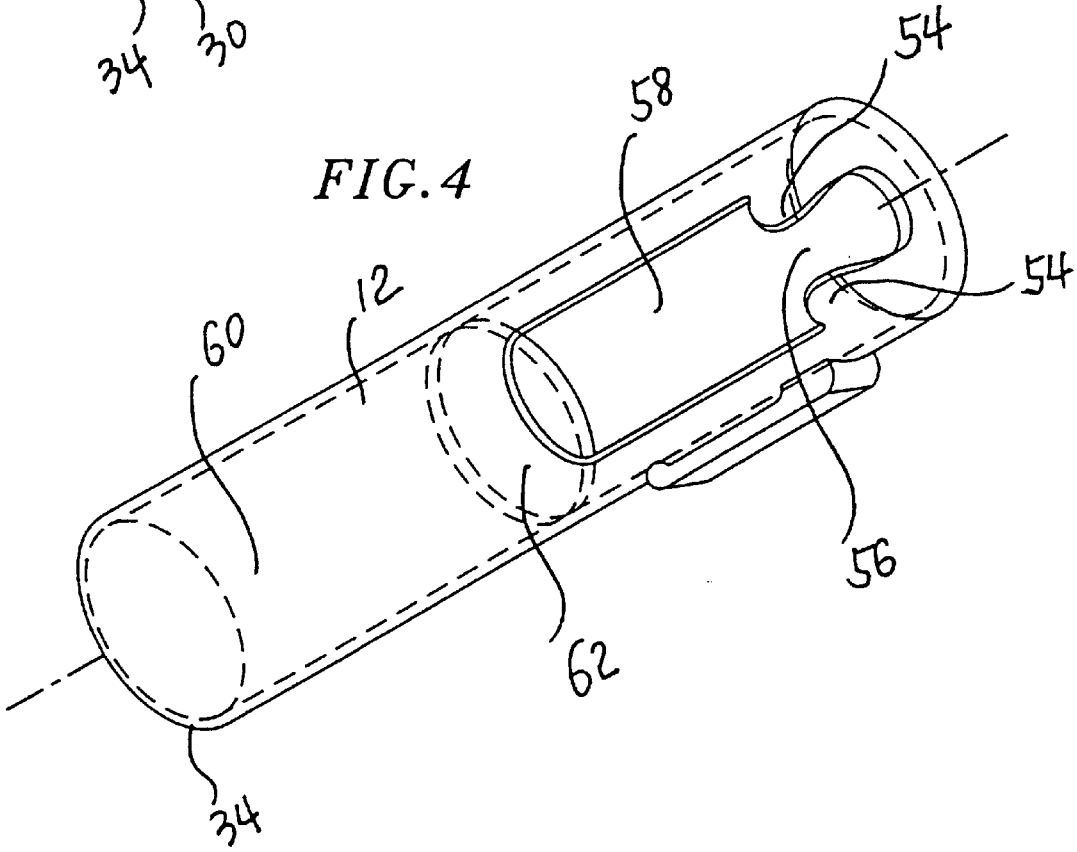
FIG. 4 is a perspective view illustrating a housing in FIG. 2.

FIGS. 2 and 4 respectively show another preferred embodiment. First, the housing cavity 32 in FIG. 3 is divided into a first cavity 58 and a second cavity 60 by use of a membrane 62, as shown in FIG. 4. The front end 28 of the housing 12 has a pair of protrusions 54 elastically approaching toward each other. Here, a hiatus 56 is formed between the pair of protrusions 54 while channeling the first opening 22 and the second opening 24.

In this construction, a conventional tooth paste tube 17 having a neck 18 is inserted through the second opening 24 and through the hiatus 56 by use of elasticity of the protrusions 54 of the first end 28 into the first cavity 58 so that the neck 18 of the tooth paste tube 17 can be removably fixed through the first opening 22 while securely holding the tooth paste tube 17.

The membrane 62 is spaced from the second opening 24 and fixedly attached on and across an inner periphery of the housing 12. The membrane 62 may be formed of one selected from a PVC, a plastic material, and other commonly known alternatives.

Figure 5:
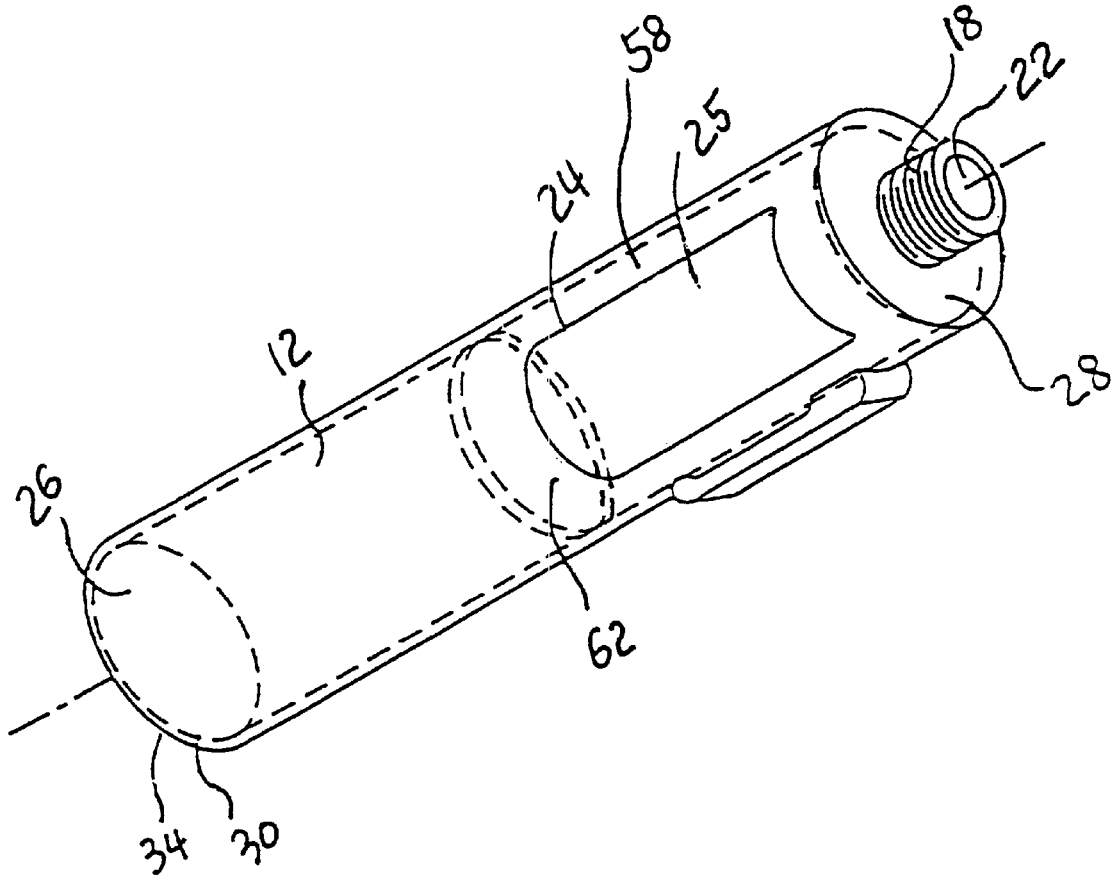
FIG. 5 is a perspective view illustrating a housing according to still another embodiment of the present invention.

Referring to FIG. 5, in an improvement of the present invention, the first cavity 58 of the housing 12 is secured for containing a tooth paste. That is, the front end 28 has the conventional tooth paste neck 18 extending therefrom and the neck cap 20 in FIG. 1 can be carried on the neck 18. The first opening 22 in FIG. 3 becomes a neck hole 22 formed in and through the neck 18. In particular, a flexible window 25 sealingly covers the second opening 24. The membrane 62 becomes provided below the flexible window 25 and between the first end 28 and the second end 30 so that the tooth paste can be contained in the first cavity 58, that is, between the membrane 62 and the front end 28 so that the flexible window 25 can be pressed to squeeze out a desired amount of the tooth paste through the neck 18.

The advantages of the article 10 for oral care according to the present invention are numerous. First, the oral care article enables a conventional tooth paste tube to partially serve as a handle of the tooth brush, thereby realizing compactablility.

Second, the threaded neck of a conventional tooth paste tube may be utilized for detachable but safe connection between the tooth brush section and the housing, thereby improving convenience and usability.

Third, the simplified overall construction of the article for oral car according to the present invention may have a clip attached on the housing, thereby realizing portability.

Although the present invention has been described in considerable detail with reference to certain preferred versions thereof, other versions are possible by converting the aforementioned construction. Therefore, the scope of the invention shall not be limited by the specification specified above and the appended claims.

What is claimed is:

1. A compact article for oral care comprising:

a) a housing having a first opening, a second opening, a third opening, a front end, a rear end, and a cavity communicating with the first opening and the second opening, wherein the front end has a tooth paste neck extending therefrom and a neck cap removably carried on the neck, wherein a neck hole in and through the neck is the first opening, wherein a flexible window sealingly covers the second opening, the second opening being formed in a sidewall of the housing wherein a membrane is provided below the flexible window and between the front end and the rear end, for containing a tooth paste between the membrane and the front end, the flexible window adapted to be pressed to squeeze out a desired amount of the tooth paste through the neck, wherein the third opening is defined by an opening rim at the rear end of the housing; and b) a tooth brush section having a base, a first extension, a second extension, a connecting rod and a brush, wherein the first extension having a first perimeter is protruded in a decremental step from the base to a forward direction so that the connecting rod is fixedly attached to the first extension, the brush being connected to the connecting rod, wherein the second extension having a second perimeter is protruded in a decremental step from the base to a rearward direction opposed to the first extension, wherein the first perimeter equals the second perimeter, whereby a selected one of the first and second extensions is detachably connectable to the opening rim of the housing through the third opening.

2. The compact article of claim 1, wherein the housing further comprises a clip having a base and an arm, wherein the clip base is fixedly attached to a predetermined portion of an outer periphery of the housing, and wherein the clip arm is elastically elongated toward the opening rim.

3. The compact article of claim 1, wherein the second opening has a length and a width, wherein the width is about one third the outer circumference of the housing, and wherein the length is about one half the distance between the front end and the rear end of the housing.

* * * * *